US006975817B2

(12) United States Patent
Rommelmann et al.

(10) Patent No.: US 6,975,817 B2
(45) Date of Patent: Dec. 13, 2005

(54) PRINTER MODULE WITH ON-BOARD INTELLIGENCE

(75) Inventors: Heiko Rommelmann, Penfield, NY (US); Alberto Rodriguez, Webster, NY (US); Scott J. Bell, Webster, NY (US); Edwin Kuyt, Marion, NY (US)

(73) Assignee: Xerox Corporation, Stamford, CT (US)

( * ) Notice: Subject to any disclaimer, the term of this patent is extended or adjusted under 35 U.S.C. 154(b) by 37 days.

(21) Appl. No.: 10/458,848

(22) Filed: Jun. 11, 2003

(65) Prior Publication Data

US 2004/0253011 A1 Dec. 16, 2004

(51) Int. Cl.[7] ..... G03G 15/00
(52) U.S. Cl. ..... 399/24
(58) Field of Search ..... 399/27–30, 9, 399/24

(56) References Cited

U.S. PATENT DOCUMENTS 5,101,233 A * 3/1992 Ito et al.
5,365,312 A 11/1994 Hillmann et al. ..... 355/206
5,410,641 A * 4/1995 Wakabayashi et al.
5,486,899 A * 1/1996 Iimori et al.
6,155,664 A * 12/2000 Cook
6,532,351 B2 3/2003 Richards et al. ..... 399/111
2001/0007458 A1 7/2001 Purcell et al. ..... 347/19
2002/0012541 A1 1/2002 Takemoto et al. ..... 399/12
2002/0164168 A1 * 11/2002 Hayakawa ..... 399/27

FOREIGN PATENT DOCUMENTS

EP 1 153 752 A2 11/2001
EP 1 211 081 A2 6/2002
EP 1 389 531 A1 2/2004
JP 2001154544 A * 6/2001 ..... G03G 21/00

* cited by examiner

*Primary Examiner*—Arthur T. Grimley
*Assistant Examiner*—Ryan Gleitz
(74) *Attorney, Agent, or Firm*—David J. Arthur

(57) ABSTRACT

An intelligent on-board monitoring system for replaceable module for a printing apparatus includes a memory element, an input for receiving information either from sensors on the replaceable module, or from the printing apparatus concerning printing operations performed, and a microprocessor connected to the memory for performing calculations upon data stored in the memory and upon the input information. The calculations produce results related to the performance of the replaceable module. These results can either be communicated to the printing apparatus, or used to control an adjustable operating parameter of the replaceable module itself, all without requiring computational resources of the printing apparatus itself.

8 Claims, 6 Drawing Sheets

PRINTER MODULE WITH ON-BOARD INTELLIGENCE

BACKGROUND

The present invention relates to replaceable modules of a printing apparatus, and particularly to the monitoring of the performance and status of such replaceable modules in the printing apparatus.

Many machines have replaceable modules or subassemblies. Printing apparatus, for example, may have one or more replaceable modules, such as a fuser, a print cartridge, a toner cartridge, an electrostatic drum unit, etc. These subassemblies or modules may be individually replaceable by the user, or multiple of the assembly modules may be combined into a single customer replaceable module.

It is known to provide these replaceable modules with memory elements, such as electrically readable chips that, when the module is installed in a machine, enable the machine to read information from the memory and also to write information, such as a print count, to the module memory. The machine reads the information from the module memory element, and performs certain calculations to determine certain performance information, such as whether the replaceable module is due to be replaced. The machine updates the information in the memory element by writing to the memory element so that the machine can continue to monitor the status of the replaceable module.

SUMMARY

The present invention provides on a replaceable module for a printing apparatus a memory element for holding stored data, an input for receiving input information, such as information pertaining to the status and/or operation of the replaceable module, and a microprocessor connected to the memory for performing calculations upon a stored data and the input information to produce results relating to the performance of the replaceable module. A communication element provides for communicating the results from the microprocessor to the printing apparatus. In a particular embodiment, the replaceable module includes an operating element that has adjustable operating parameters, and the operating element is connected to the memory element or the microprocessor to receive the results from the microprocessor, so that the results from the microprocessor can adjust the operating parameters of the operating element. In another embodiment, the microprocessor is configured to calculate a status decision concerning the status of the replaceable module based on the input information, and the communication element is configured to communicate the status decision to the printing apparatus.

A method of operating a replaceable module for a printing apparatus includes obtaining stored data in a memory element attached to the replaceable module, providing input information to a module microprocessor also attached to the replaceable module, and calculating results in the module microprocessor from the stored data and the input information. The method may further include communicating the calculated results to the printing apparatus. The method, in an alternative implementation, may include using the calculated results to alter an operational parameter of the replaceable module.

DETAILED DESCRIPTION

While the present invention will herein be described in connection with particular embodiments thereof, the invention is not limited to those particular embodiments. On the contrary, the invention covers all the alternatives, modifications, and equivalence that may be included within the spirit and scope of the invention as defined by the attached claims.

Figure 1:
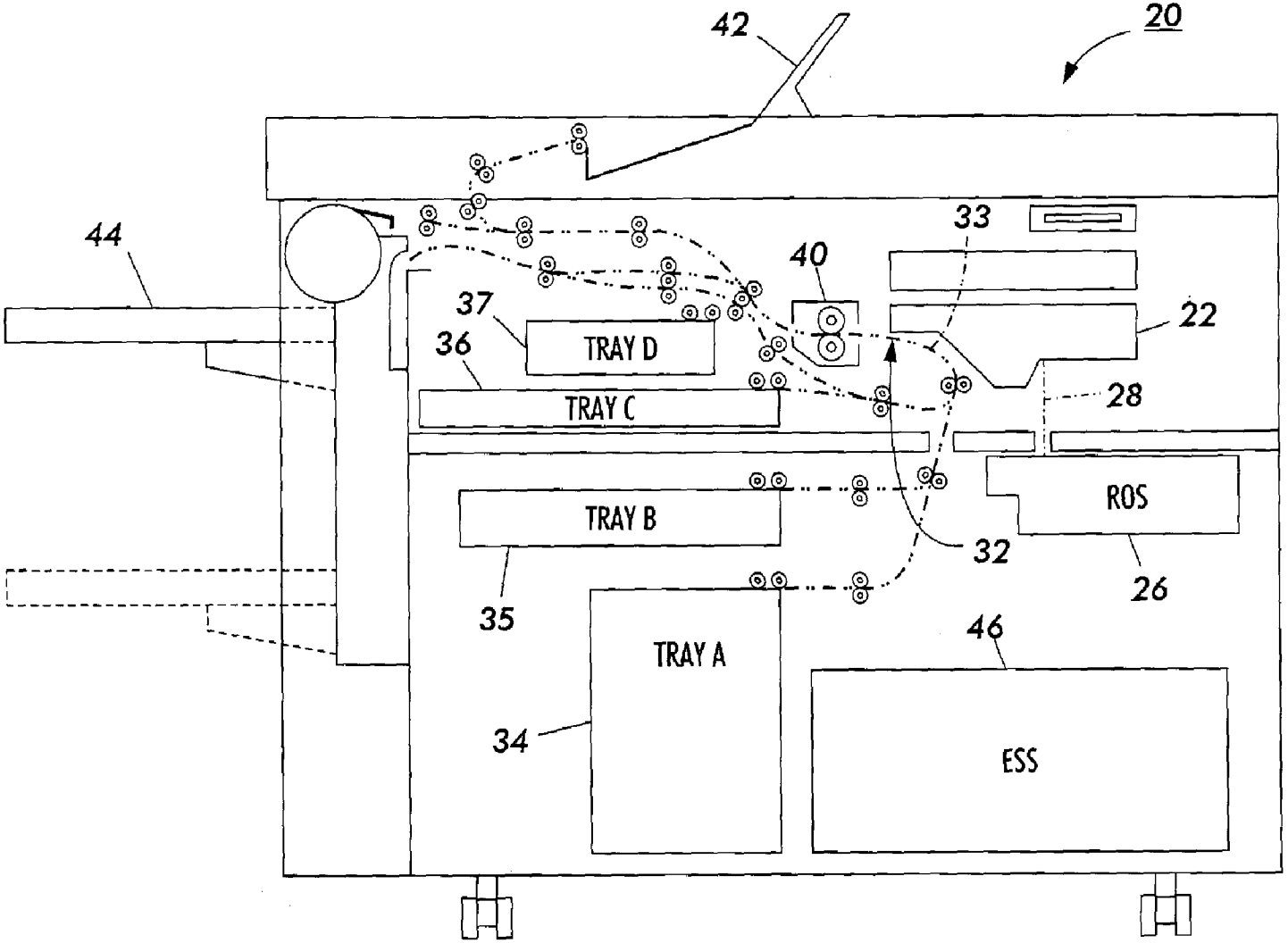
FIG. 1 is a schematic representation of a printing apparatus that can receive a replaceable module.

FIG. 1 schematically shows a printing apparatus, such as an electrostatic or xerographic printer 20, which is commonly called a laser printer. The configuration shown is exemplary only. Persons familiar with printing apparatus will understand that such printers can be implemented in numerous configurations and arrangements. The printing apparatus employs one of more replaceable modules, such as a print cartridge 22. The replaceable print cartridge is shown in greater detail in FIGS. 2 and 3, and comprises several individual printer elements. The print cartridge encloses a xerographic imaging member, such as an endless flexible photoreceptor belt 24, or a photoreceptor drum. In accordance with known xerographic printing techniques, a raster output scanner (ROS) 26 provides an imaging beam 28 that is directed at the photoreceptor belt 24 through an imaging slit 30 in the print cartridge. The imaging beam 28 forms an electrostatic image on the photoreceptor belt 24. The image is developed within the print cartridge, and transferred, at a transfer station 32, to a print medium that passes the transfer station 32 on a media path 33. Referring back to FIG. 1, the printing apparatus delivers the print medium from a media supply tray, which may be one of a plurality of media supply trays 34–37 within or attached to the printing apparatus. The transferred image is fused to the print medium at a fusing station 40. The print medium containing the transferred and fused image is delivered out of the printing apparatus. For example, the print medium containing the image may be delivered to a sample tray 42 that may be on the top of the printing apparatus, or to an output tray such as a stacking tray 44 on the side of the printing apparatus. Persons skilled in the art will recognize that an alternative is that the print medium with the fused image on one side may be put into a trayless duplex path (not shown) within the printing apparatus, to be returned to the transfer station 32 to receive an image on the other side of the print medium before being delivered to one of the output trays 42, 44 of the printing apparatus. The operation of the printing apparatus, including the control of the transport of the print medium, the processing of input image information, and the transfer of that image information to the raster output scanner, as Well as the control of the elements within the print cartridge, are all controlled by an electronic subsystem (ESS) 46. The electronic subsystem 46 may also include one or more machine control units or central processing units that include microprocessors and suitable memories, for storing machine operating software.

Figure 2:
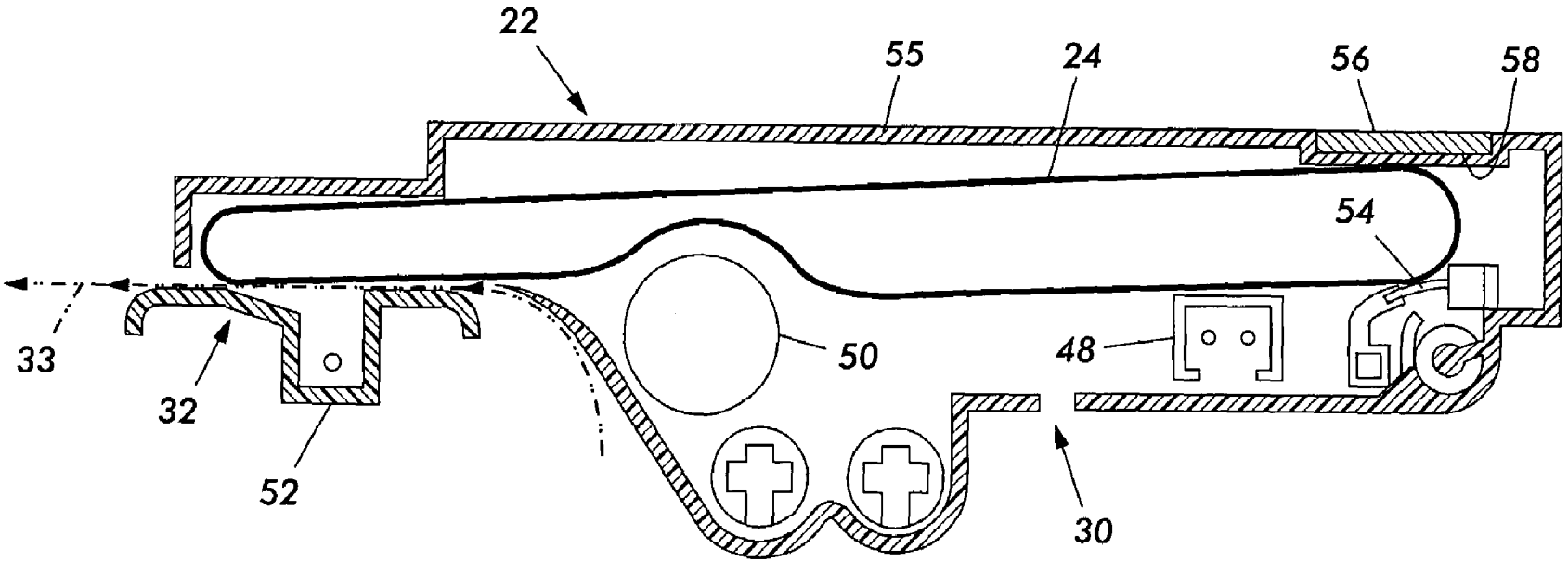
FIG. 2 is a cross-sectional view of a replaceable module for the printing apparatus of FIG. 1.

The print cartridge module 22 shown in FIG. 2 may also include a charge scorotron 48, a developer device 50, a transfer corotron 52, a cleaning device 54, and a housing 55. The charge scorotron is located upstream of the imaging slit 30 in the cassette to apply a uniform electrostatic charge to the surface of the photoreceptor belt 24 before the photoreceptor belt is exposed to the imaging beam. The developer device 50 is located downstream of the imaging slit to bring developer mixture into proximity with, and thereby develop, the electrostatic latent image on the photoreceptor belt. The developer mixture is a component mixture comprising toner and a magnetically attractable carrier. Toner is transferred to the photoreceptor belt during image development and replacement toner is dispensed periodically from a hopper or container (not shown) into the housing of the developer device. The transfer corotron 52 is located at the transfer station 32 to assist in transferring the developed image from the belt to the print medium that enters the print cartridge at that point. Finally, a cleaning device 54 removes any residual toner particles from the surface of the photoreceptor belt. The photoreceptor belt is then illuminated by a discharge lamp to remove any electrostatic charge remaining on the photoreceptor belt.

The print cartridge 22, as has already been mentioned, may be removed from the printing apparatus, and replaced with another print cartridge. Such replacement typically takes place if any of the process elements located within the print cartridge deteriorate. The print cartridge has an on-board monitoring system 56 securely attached to the replaceable module. In a particular illustrated implementation, the on-board monitoring system is securely attached to a section 58 of the replaceable module.

Figure 4:
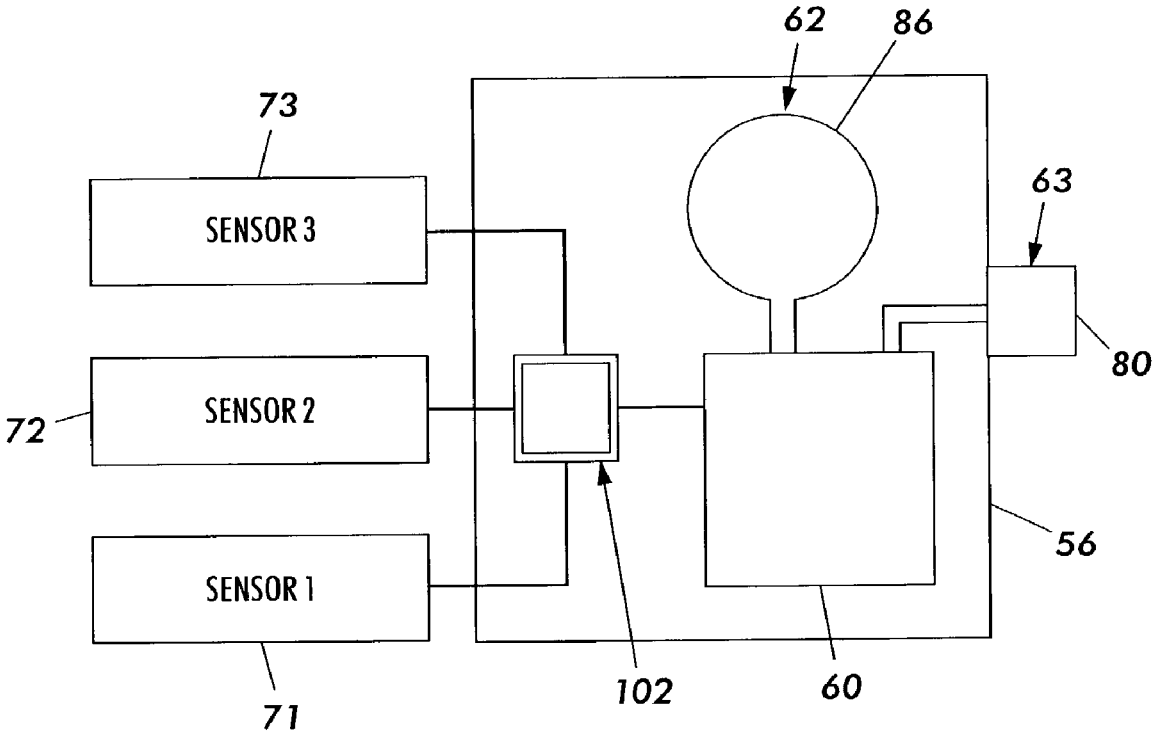
FIG. 4 is a schematic diagram of an intelligent on-board monitoring element for the replaceable module of FIG. 3.

Referring now to FIG. 4, the on-board monitoring system 56 includes a processing element 60 and one or more communication elements 62, 63 for communicating between the on-board monitoring system and another device, such as the printing apparatus.

Figure 5:
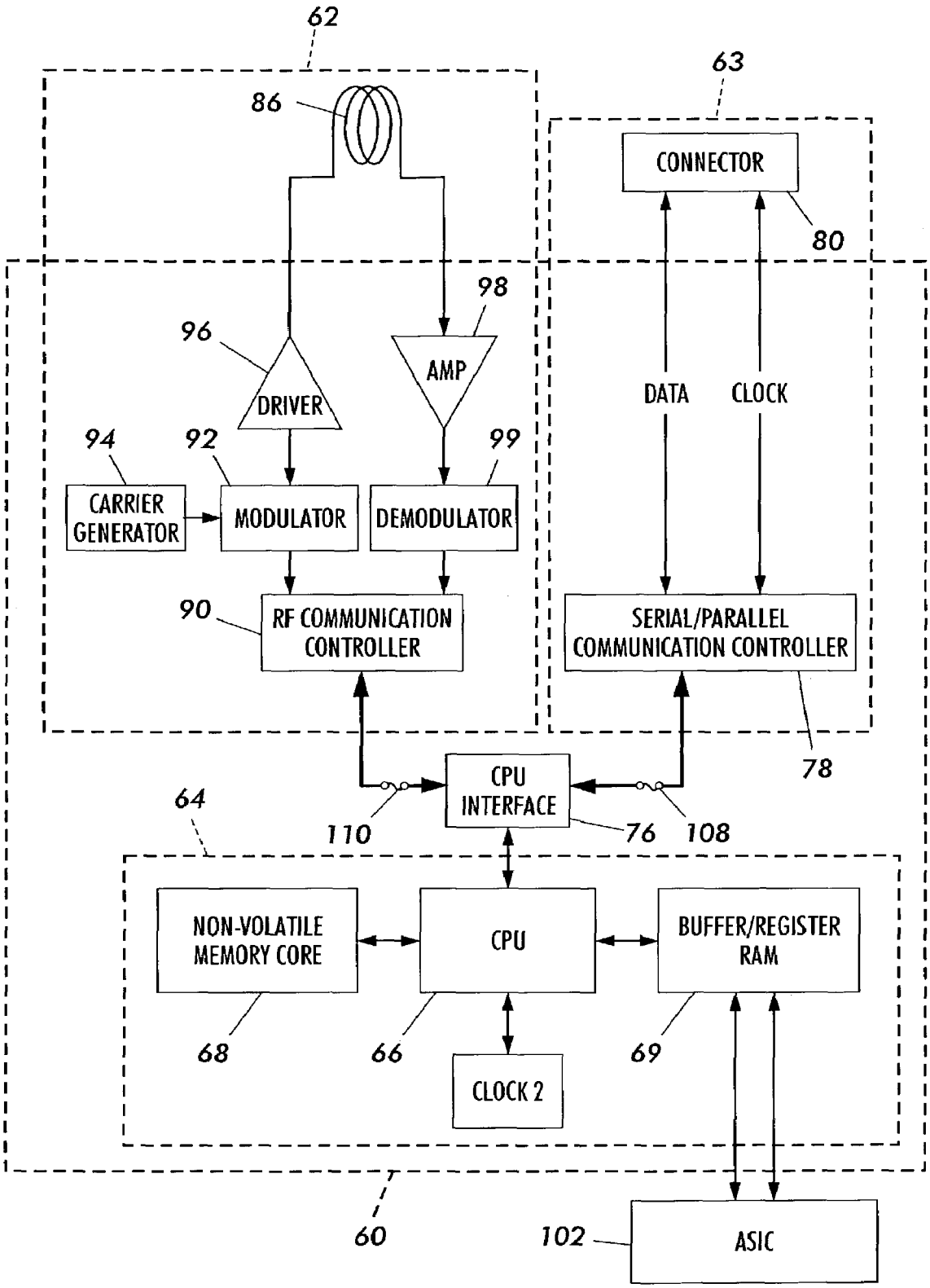
FIG. 5 is a schematic diagram of a portion of the intelligent on-board monitoring system of FIG. 4.

Referring next to FIG. 5, an exemplary processing element 60 includes a microprocessor 64 that contains a central processing unit (CPU) 66 and memory elements 68, 69. The memory elements may include a non-volatile memory core portion 68 for holding permanent information, such as operating software, device identifying information, or other such information, and information that may be changeable, but is to be retained through a power-off, power-on sequence. The memory also includes a volatile memory portion, such as random access memory 69. The memory elements 68, 69 are connected to the central processing unit 66 so that the central processing unit can receive information and instructions from the memory elements. The central processing unit is also connected to the memory elements 68, 69 so that the central processing unit can write information into the memory elements.

The on-board monitoring system also includes one or more sensors 71, 72, 73. The sensors gather or detect information pertaining to the replaceable module and/or its operating environment. For example, one sensor 71 may detect when the quantity of toner in the print cartridge falls below a particular threshold. Another sensor 72 may detect when the photoreceptor belt is worn. A third sensor 73 may sense the condition of the cleaning device. Persons skilled in the art will recognize that depending on the replaceable module to which the monitoring system is attached, different parameters and information can be gathered that may be relevant to the operation of the printing apparatus and/or the replaceable module. Because of such variations, the sensors 71, 72, 73 are shown only in schematic form.

Figure 3:
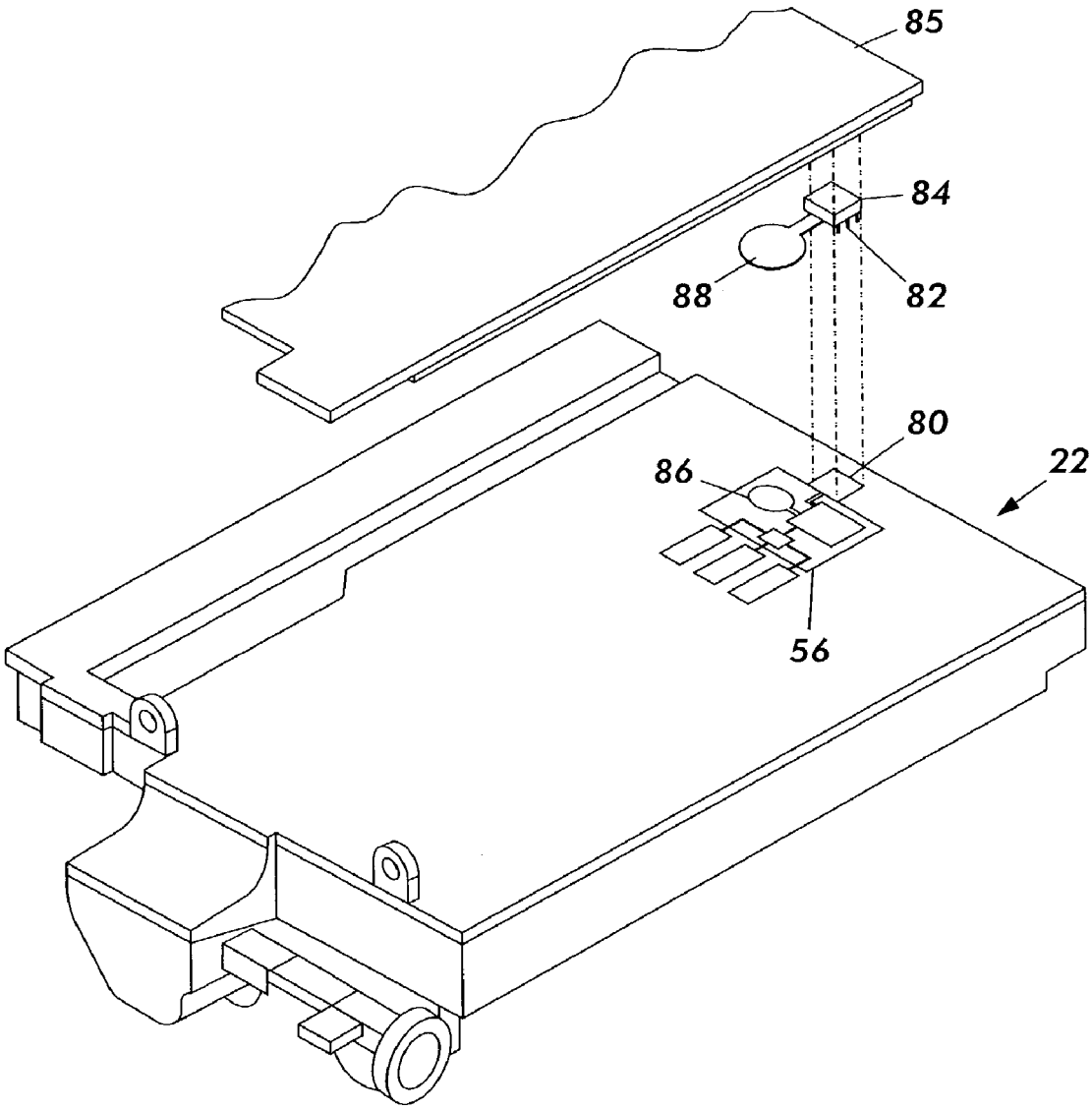
FIG. 3 is a perspective view of the replaceable module of FIG. 2.

The monitoring system includes one or more communication elements 62, 63 for communicating information to and from another device, such as the printing apparatus. The particular embodiment includes both a hardwire communication element 63 and a wireless communication element 62. Portions of the communication elements 62, 63 may be part of the processing element 60, or may be separate elements. The communication elements connect to the central processing unit 66 through a CPU interface 76. The hardwire communication element 63 includes a serial/parallel communication controller 78 that controls communication through an external connector 80. The external connector may be a pin and socket type connector of conventional construction. For example, the external connector on the monitoring system may include a plurality of sockets that interact with pins 82 extending from a printer connector 84 (FIG. 3). The printer connector 84 is securely attached to a portion 85 of the printing apparatus so that the pins of the printing connector fit into the sockets of the replaceable module monitoring system connector when the replaceable module is properly inserted into the printing apparatus.

The replaceable module monitoring system may also include a wireless communication element 62. The wireless connector element may include a radio frequency communication elements, including an antenna 86. The wireless connector or communication element communicates over a wireless communication link provided between the antenna 86 on the replaceable module monitoring system and a comparable RF antenna 88 on the printing apparatus. In certain circumstances, it may be desirable for all information communication to take place using the wireless communication element, so that the hardwire communication element can be as simple as possible. For example, a simple two wire connection can deliver power from the printing apparatus to the replaceable module monitoring system.

The radio frequency wireless communication element includes an RF communication controller 90 that connects to the CPU 66 of the microprocessor 64 through the CPU interface 76. The RF communication controller 90 provides a signal to a modulator 92. The modulator 92 modulates the signal onto a RF carrier signal generated by a carrier generator 94. A driver 96 conveys the modulated RF signal to the antenna 86. RF signals received at the antenna 86 are amplified by an amplifier 98, and demodulated by a demodulator 99 before being passed on to the RF communication controller 90. Wireless and wireless communication elements are described in U.S. Pat. No. 6,532,351 to Richards et al. on Mar. 11, 2003, the contents of which are hereby incorporated by reference.

An application specific integrated circuit (ASIC) 102 (FIG. 4) provides the interface between the replaceable module monitoring system sensors 71–73 and the processing element 60. As persons familiar with the art will recognize, the ASIC is specially designed to convert signals received from the sensors into digital data appropriate for processing by the microprocessor.

The microprocessor 64 of the processing element 60 receives input information from the sensors 71–73 through the ASIC, or from the printing apparatus through one of the communication elements 62, 63. In addition, the non-volatile memory 68 may contain information pertinent to the replaceable module itself. The central processing unit 66 performs arithmetic operations, or calculations upon input information data from the memory elements to produce calculated results. The central processing unit then delivers the calculated results to the volatile (random access) memory 69 and/or the non-volatile memory 68.

An on-board monitoring system for a replaceable unit for a printing apparatus can perform entirely on the replaceable module various calculations and other operations, reducing the need to communicate with the printing apparatus, and also reducing the computational requirements imposed upon the printing apparatus.

There are numerous operations and functions that can be performed using the on-board monitoring system incorporating a microprocessor. For example, the printing apparatus can supply to the monitoring system information about print operations that the print module is called upon to perform. Such information may include information that can be used to estimate the amount of usage to which the replaceable module is put. Persons skilled in the art will recognize that certain printing information can be used to estimate the remaining life of certain components within a replaceable module. For example, if the replaceable module contains a consumable material, such as toner, retaining information about the quantity of printing performed by the replaceable module can be used to estimate when the supply of the consumable material is nearly exhausted. Thus, the printing apparatus may supply to the monitoring system information about the number of pixels in the images printed, or the number of pages printed, or other relevant information. With the on-board intelligent monitoring system, the microprocessor can process the information received from the printing apparatus concerning printing operations performed, and combine that information with previously stored information pertaining to the expected life of the components in the replaceable module. The CPU 66 can calculate using that information when the expected end of life for the replaceable module, or some component thereof, is reached, or is about to be reached. Upon making such a calculation, the CPU can then communicate to the printing apparatus a status decision, such as "toner low" or other relevant decisional information. In this way, the resources of the computational processing elements within the printing apparatus are not consumed performing such calculations that relate only to the particular replaceable module. In addition, performing such calculations in the intelligent monitoring system on-board the replaceable module reduces the amount of data that must be communicated between the replaceable module and the printing apparatus.

In another mode of operation, the computational process undertaken by the CPU of the intelligent monitoring system on the replaceable module may take into account information about the status of the replaceable module as detected by the sensors. For example, if, a toner level sensor detects that the toner level within the replaceable module is low, that information, delivered to the microprocessor through the ASIC can be processed by the CPU, so that a status decision ("low toner") can be communicated to the printing apparatus. Persons skilled in the art will recognize that the microprocessor of the intelligent monitoring system can perform numerous evaluations based on various combinations of permanent information stored in the non-volatile memory, print operation information received from the printing apparatus, and status information received from the sensors.

In yet another mode of operation, the intelligent monitoring system facilitates the upgrading of a replaceable module without requiring that the electronics or software of the printing apparatus be correspondingly changed. This greatly simplifies the ability to improve the performance of the replaceable modules of a printing apparatus. When new performance characteristics are built into a replaceable module, the microprocessor 64 of the intelligent monitoring system on the replaceable module 22 may be programmed to reflect those improved performance characteristics. The central processing unit of the microprocessor of the intelligent monitoring system can then perform the requisite calculations to take into account the altered performance characteristics, and deliver to the printing apparatus information that has been adjusted to take such altered performance characteristics into account. For example, if the printing apparatus is designed to receive status decision information only, the intelligent monitoring system provides to the printing apparatus the correct status decision in accordance with the altered performance characteristics. Even if the printing apparatus is designed to perform its own decision processes, the microprocessor of the intelligent monitoring system can be programmed to alter the information provided to the printing apparatus so that the printing apparatus operates correctly upon the improved replaceable module. The printing apparatus may be designed to receive module data from the replaceable module and use a particular first algorithm or procedure to determine a module status result. If the new module calls for the module status result to be determined using a different (second) algorithm or procedure, the intelligent on-board monitoring system can prepare modified module data so that the printing apparatus itself does not need to be modified to include the second algorithm. The microprocessor of the intelligent on-board monitor receives input module data, and calculates the modified module data, and communicates the modified module data to the printing apparatus. The modified module data is prepared so that, when the printing apparatus applies its first algorithm to the modified module data, the printing apparatus produces module status results as though it were using the second algorithm on the input module data.

If for example, the printing apparatus is programmed to indicate that the photoreceptor belt is worn to an unacceptable degree after a certain number of images have been applied upon it, but a new photoreceptor belt is installed that permits a greater number of images to be applied before its performance deteriorates, the intelligent monitoring system can be programmed so that it delivers to the printing apparatus information that leads the printing apparatus to believe that fewer prints have been made using the photoreceptor belt, proportioned in accordance with the improved longevity of the photoreceptor belt actually installed. In an example, if a printing apparatus is designed with a replaceable module having a life of, ten thousand prints, the programs within the printing apparatus may be set up to inform the user after such ten thousand prints that the usable life of the replaceable module is finished, and the replaceable module should be replaced. If subsequent improvements to the replaceable module provided with a useful life of, for example, twenty thousand prints, an intelligent monitoring system incorporating a microprocessor can be configured to inform the printing machine of only half the prints actually made using the replaceable module. In this way, the printing apparatus indicates the end of the useful life of the replaceable module at the conclusion of twenty thousand prints, rather than prematurely at ten thousand prints, without having to program the printing apparatus.

Figure 6:
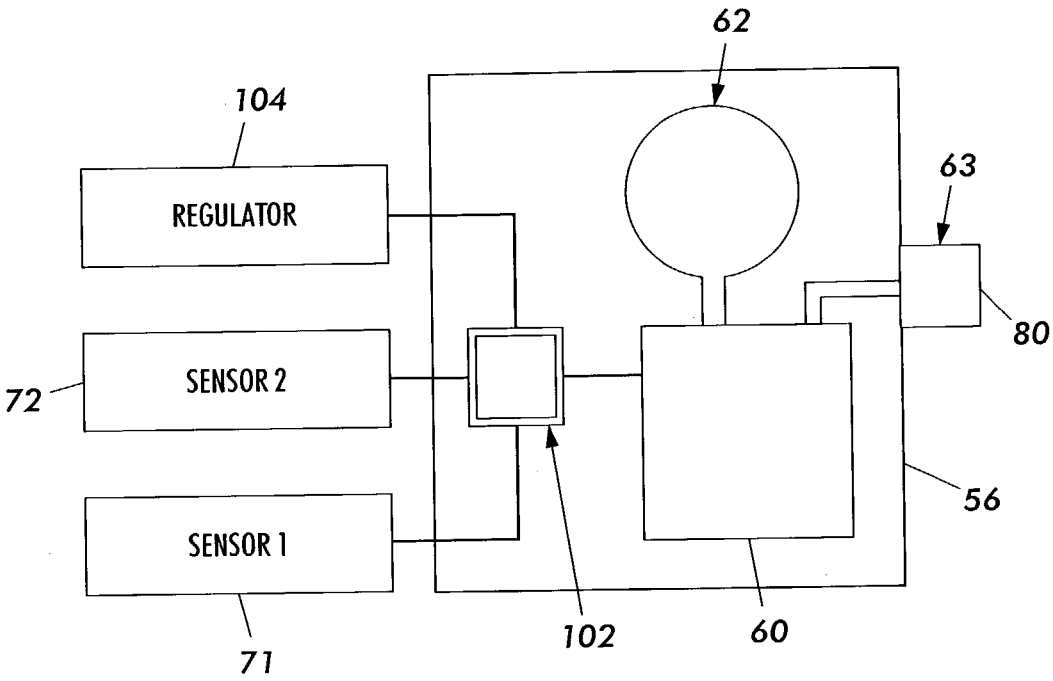
FIG. 6 is a schematic diagram of an alternative embodiment of an intelligent on-board monitoring system for a replaceable module of a printing apparatus.

FIG. 6 illustrates an implementation in which the intelligent monitoring system can also be used to control one or more operating parameters of the replaceable unit. Referring now to FIG. 6, in addition to the sensors 71, 72 for detecting status input information from the replaceable module, the system includes a regulator or controller 104 that is connected to operate one of the operating elements of the replaceable unit, such as the charge scorotron 48 or the transfer corotron 52 (FIG. 2). The regulator may govern, for example, the voltage applied to the operating element, the timing of an electrical charge or signal applied, or some other factor. The microprocessor 64 of the processing core 60 provides a control signal through the ASIC 102 and the regulator 104 to control the operation of the operating element. This arrangement permits altering the performance characteristics of the operating element without requiring that new or additional control software be installed into the printing apparatus. If, upon manufacturing or refurbishing the print cartridge, the performance characteristics of, for example, the corotron, are altered such that different control signals are desired, the microprocessor 64 of the intelligent monitoring system can be reprogrammed so that the calculations performed in the central processing unit generate the appropriate signals to be delivered through the ASIC and the regulator for altering the operating parameters of the operating element.

Figure 7:
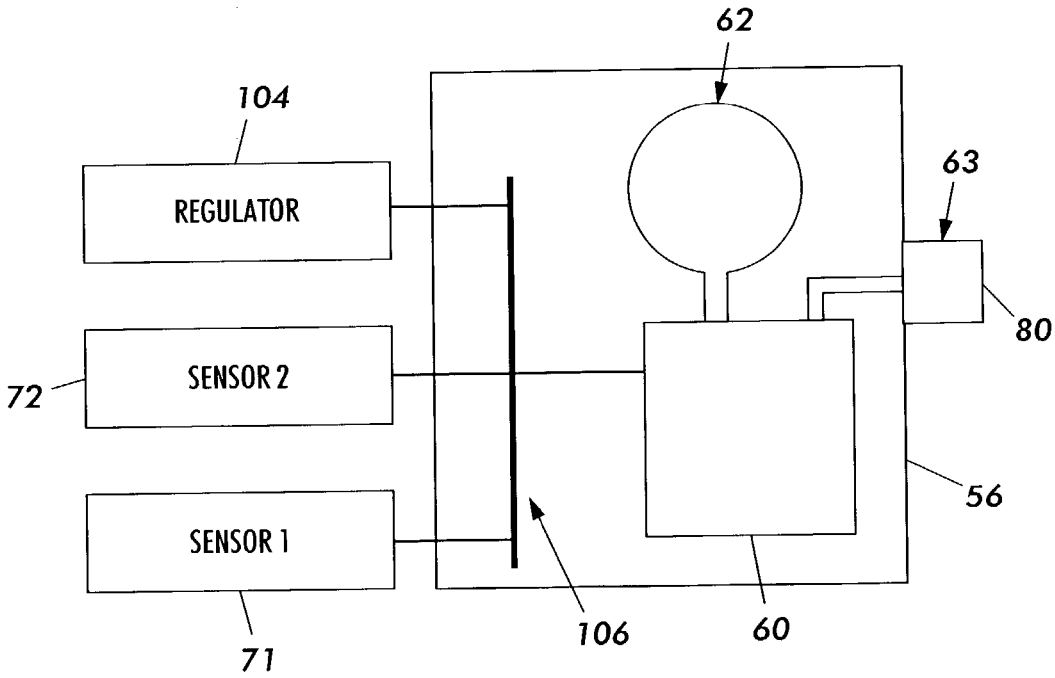
FIG. 7 is a schematic diagram of yet another alternative embodiment of an intelligent on-board monitoring system replaceable module of a printing apparatus.

FIG. 7 shows an implementation of the intelligent on-board monitoring system that is similar to the embodiment illustrated in FIG. 6, except that the interface between the processing element 60 and the sensors 71, 72 and/or regulators 104 is a serial bus 106, rather than an ASIC. The sensors and regulators used in the embodiment illustrated in FIG. 7 include integrated signal conditioning and processing, and also a serial interface. The sensors thus properly condition and process the sensed data for transmission upon the serial bus. The regulator 104 then receives the appropriate serial information, and prepares it for use in regulating the operation of an operating element of the replaceable module.

The communication elements, and the wireless communication element in particular, can be used for communicating with devices other than the printing apparatus. As described in previously noted in U.S. Pat. No. 6,532,351 B2 to Richards et al., if the wireless communication element is such that it operates with wireless signals that can pass through the packaging in which the replaceable unit is shipped, the wireless communication and element can be used to receive data and program the processing element during warehousing and shipment of the replaceable unit. Following such programming, the wireless communication element can be disabled, leaving the wired communication element for connection to the printer, or the wireless communication element can remain operational for use with in wireless communication between the printing apparatus and the replaceable module. Fuses 108, 110 connecting the wired and wireless communication elements 63, 62 to the CPU interface 76 provide an exemplary technique for permitting either communication link to be severed when that communication link is no longer needed. In an alternative, information transfer occurs through the wireless communication element 62, and the hardwire communication element transfers only electrical power. In such an arrangement, the serial/parallel communication controller 78 may be unnecessary.

Persons skilled in the art will recognize that numerous modifications and enhancements to the particular embodiments described above can be made without departing from the spirit and scope of the present invention. For example, numerous other modes of operation in which information is processed by the microprocessor of the intelligent on-board monitoring system can be devised based on the knowledge of the person of ordinary skill in the art after reading the above description of a few particular implementations. In addition, persons skilled in the art will recognize that the intelligent on-board monitoring system can be applied to a wide variety of modules of a printing apparatus, some of which may be single purpose modules, and others may incorporate multiple elements, such as the printer cartridge described in the particular embodiment above. Furthermore, although an exemplary implementation in an electrostatic printing apparatus has been described in detail, the principles of the implementation can be applied to replaceable modules of other types of printers, such as ink jet (liquid, phase change, acoustic, etc.) Therefore, the invention is not limited to the particular implementations described above.

We claim:

1. A method of determining a status of a replaceable module of a printing apparatus, wherein the printing apparatus is configured to use a first machine procedure to calculate a module status result for the replaceable module using module data provided by the replaceable module to the printing apparatus, the method comprising:

receiving module data at a microprocessor attached to the replaceable module;

calculating in the microprocessor altered module data from the module data; and communicating the altered module data to the printing apparatus;

wherein the altered module data, when processed using the first machine procedure produces the module status result as though the printing apparatus had used a second machine procedure to calculate the module status result using the module data.

2. A method of operating an apparatus having a replaceable module, wherein the apparatus performs a first predetermined algorithm on module data received from the replaceable module to produce a first response, the method comprising:

receiving input data at the replaceable module;

altering the input data to produce altered module data, wherein the altered module data is such that when the apparatus performs the first predetermined algorithm on the altered module data, the apparatus produces a second response as though the apparatus had performed a second predetermined algorithm on the input data;

transmitting the altered module data to the apparatus.

3. The method of claim 2, wherein the apparatus is a printing apparatus and the replaceable module is a replaceable printer module, and wherein the input data comprises data pertaining to printing operations performed by the replaceable printer module.

4. The method of claim 3, wherein the first predetermined response of the printing apparatus is a first control signal for controlling the replaceable printer module, and wherein altering the input data comprises altering the input data to produce altered module data that causes the printing apparatus, when performing the first predetermined algorithm on the altered module data, to produce a second control signal, different from the first control signal, for controlling the replaceable printer module.

5. The method of claim 2, wherein the first response of the apparatus is a first control signal for controlling the replaceable module, and wherein altering the input data comprises altering the input data to produce altered module data that causes the apparatus, when performing the first predetermined algorithm on the altered module data, to produce a second control signal, different from the first control signal, for controlling the replaceable module.

6. For use in a printing apparatus that is adapted to perform a first predetermined algorithm on data received from a printer module, an intelligent module monitor attached to the printer module, the intelligent module monitor comprising:

a data input for receiving input data;

a microprocessor operatively connected to the data input, wherein the microprocessor is adapted to alter the input data to produce altered data so that when the printer performs the first predetermined algorithm on the altered data, the result is as though the printer had performed a second predetermined algorithm different from the first predetermined algorithm, on the input data; and a data output operatively for supplying the altered data to the printer.

7. The intelligent printer module monitor of claim 6, wherein in response to performing the predetermined first algorithm on data received from the printer module the printing apparatus produces a first control signal for controlling the printer module, the microprocessor is adapted to alter the input data to produce altered module data that causes the printing apparatus, when performing the first predetermined algorithm on the altered module data, to produce a second control signal, for controlling the printer module, as though the printer had performed a second predetermined algorithm different from the first predetermined algorithm, on the input data.

8. An intelligent module monitor attached to a replaceable module for use in a printer, wherein the printer is adapted to perform a first predetermined algorithm on module data from the replaceable module, wherein the module monitor comprises:

a data input for receiving input data from the module;

a microprocessor connected to the data input to receive input data from the data input;

a data output connected to the microprocessor to output data from the microprocessor;

wherein the microprocessor is adapted to alter the input data to produce altered data, which altered data is such that when the printer performs the first predetermined algorithm on the altered data, the printer responds as though the printer performed a second predetermined algorithm on the input data, wherein the second predetermined algorithm is different from the first predetermined algorithm; and wherein the microprocessor is adapted to produce the altered data as output data.

* * * * *